US006135562A

United States Patent [19]

Infanti

[11] Patent Number: 6,135,562

[45] Date of Patent: Oct. 24, 2000

[54] CHAIR WITH RELEASABLY DETACHABLE AND INTERCHANGEABLE CUSHIONS

[75] Inventor: Vittorio Infanti, Staten Island, N.Y.

[73] Assignee: Vittoria Infanti Valentine, Staten Island, N.Y.

[21] Appl. No.: 09/393,842

[22] Filed: Sep. 10, 1999

[51] Int. Cl.[7] ..... A47C 7/00

[52] U.S. Cl. ..... 297/440.2; 297/440.14; 297/440.15; 297/440.22; 297/452.14; 297/452.55

[58] Field of Search ..... 297/440.2, 440.14, 297/440.22, 440.15, 452.55, 452.38, 452.14

[56] References Cited

U.S. PATENT DOCUMENTS

| | | | |
|---|---|---|---|
| 3,455,605 | 7/1969 | Anderson | 297/440.2 X |
| 3,695,707 | 10/1972 | Barecki et al. | 297/452.55 |
| 3,825,302 | 7/1974 | Kurtz | 297/440.22 |
| 3,861,747 | 1/1975 | Diamond | 297/452.55 |
| 4,099,774 | 7/1978 | Sandham | 297/440.2 X |
| 4,871,209 | 10/1989 | Handelman | 297/452.55 X |
| 4,913,496 | 4/1990 | Oke | 297/440.15 |
| 5,297,851 | 3/1994 | Van Hekken | 297/452.14 |
| 5,487,591 | 1/1996 | Knoblock | 297/452.14 |
| 5,524,971 | 6/1996 | Jay et al. | 297/440.2 X |
| 5,609,395 | 3/1997 | Burch | 297/452.55 |
| 5,779,317 | 7/1998 | Neal | 297/440.2 |
| 5,865,508 | 2/1999 | Martin | 297/440.15 X |

*Primary Examiner*—Peter M. Cuomo
*Assistant Examiner*—Rodney B. White
*Attorney, Agent, or Firm*—Pitney, Hardin, Kipp & Szuch, LLP

[57] ABSTRACT

The chair includes a seat back which is engaged to a seat base by an L-shaped bracket. A seat cushion is upholstered to seat cushion plate. Front and rear seat back cushions are upholstered to front and rear seat back cushion plates. The seat cushion plate includes insert molded snap fasteners which are complementary to insert molded fasteners or apertures on the seat base for releasing attaching the seat cushion plate to the seat base. Likewise, the front and rear seat back cushion plates could include insert molded snap fasteners or other hardware which are complementary to insert molded snap fasteners on the front and rear of the seat back for releasably attaching the front and rear seat back cushion plates to the front and rear of the seat back.

9 Claims, 5 Drawing Sheets

CHAIR WITH RELEASABLY DETACHABLE AND INTERCHANGEABLE CUSHIONS

BACKGROUND OF THE INVENTION

1. Field of the Invention

This invention pertains to a chair with a releasably detachable and interchangeable seat cushion, and releasably detachable and interchangeable front and rear seat back cushions mounted to injection molded plates. Additionally, the seat back can be interchanged with different seat back styles.

2. Description of the Prior Art

In the prior art, the cushions and seat back used in chair design are meant to be permanently affixed for a given chair. That is, the seat cushion and the front and rear seat back cushions are intended to remain with the chair and can be replaced only by reupholstering or similar substantial effort. Similarly, the seat back is intended to be an integral and permanent part of the chair frame and can be replaced only by a substantial labor-intensive overhauling of the chair.

Therefore, these typical prior art designs do not allow for variation in any given chair. Therefore, establishments, such as catering halls, would have to settle for using the same set of chairs for all occasions.

Similarly, when a single cushion was damaged, such as by a cigarette burn, these prior art chairs could require substantial reupholstering and repair. Alternately, the establishment would have to purchase extra chairs.

OBJECTS AND SUMMARY OF THE INVENTION

It is therefore an object of this invention to provide a chair with detachable and interchangeable seat cushions and front and rear seat back cushions in order to provide for variations in the design and appearance of the chair or to provide for the quick and simple replacement of damaged cushions.

It is therefore a further object of this invention to provide a chair with a detachable and interchangeable seat back in order to provide for variations in the design and appearance of the chair.

It is therefore a further object of this invention to provide a chair wherein the seat cushions and front and rear seat back/cover cushions are detachable and interchangeable with an eliminated or at least minimized requirement for tools, reupholstering or other specialized effort.

It is therefore a further object of this invention to provide a chair wherein the seat back can be replaced without the need for extensive or specialized effort.

It is therefore a further object of this invention to provide the above objects while maintaining the structural integrity and lifetime of the chair.

It is therefore a further object of this invention to provide the above objects while maintaining practical and economical manufacturing costs.

These and other objects are attained by providing a chair with a frame. The frame includes the legs and a seat base with insert molded metal snap post fasteners, other snap fasteners (such as button snaps) or similar fasteners (such as hook-and-loop, that is VELCRO®) for releasably attaching a seat cushion with similar complementary fasteners. Additionally, the seat base and seat back include holes for the attachment of a seat back bracket by the use of screws. The seat back includes insert molded metal snap post fasteners, other snap fasteners (such as button snaps) or similar fasteners (again, such as hook-and-loop, that is VELCRO®) on its front and rear surfaces for releasably attaching front and rear seat back cushions. The use of these insert molded metal snap post fasteners, other snap fasteners or similar fasteners on the seat base and seat back is intended to eliminate the need for secondary tooling operations in the attachment and removal of the seat cushion and the front and rear seat back cushions. An establishment could therefore own a single set of chairs with multiple replacement cushions which could be selected as appropriate for the occasion and releasably attached to the chair. Similarly, damaged cushions could be simply detached and replaced with new cushions.

The seat base and the seat back can be made of many materials, but plastic with a metallized coating provides a luxurious metallic appearance. Powder coating, painting, or custom molding in custom selectable colors are also available.

BRIEF DESCRIPTION OF THE DRAWINGS

Further objects and advantages of the invention will become apparent from the following description and claims, and from the accompanying drawings, wherein:

DETAILED DESCRIPTION OF THE PREFERRED EMBODIMENT

Figure 1:
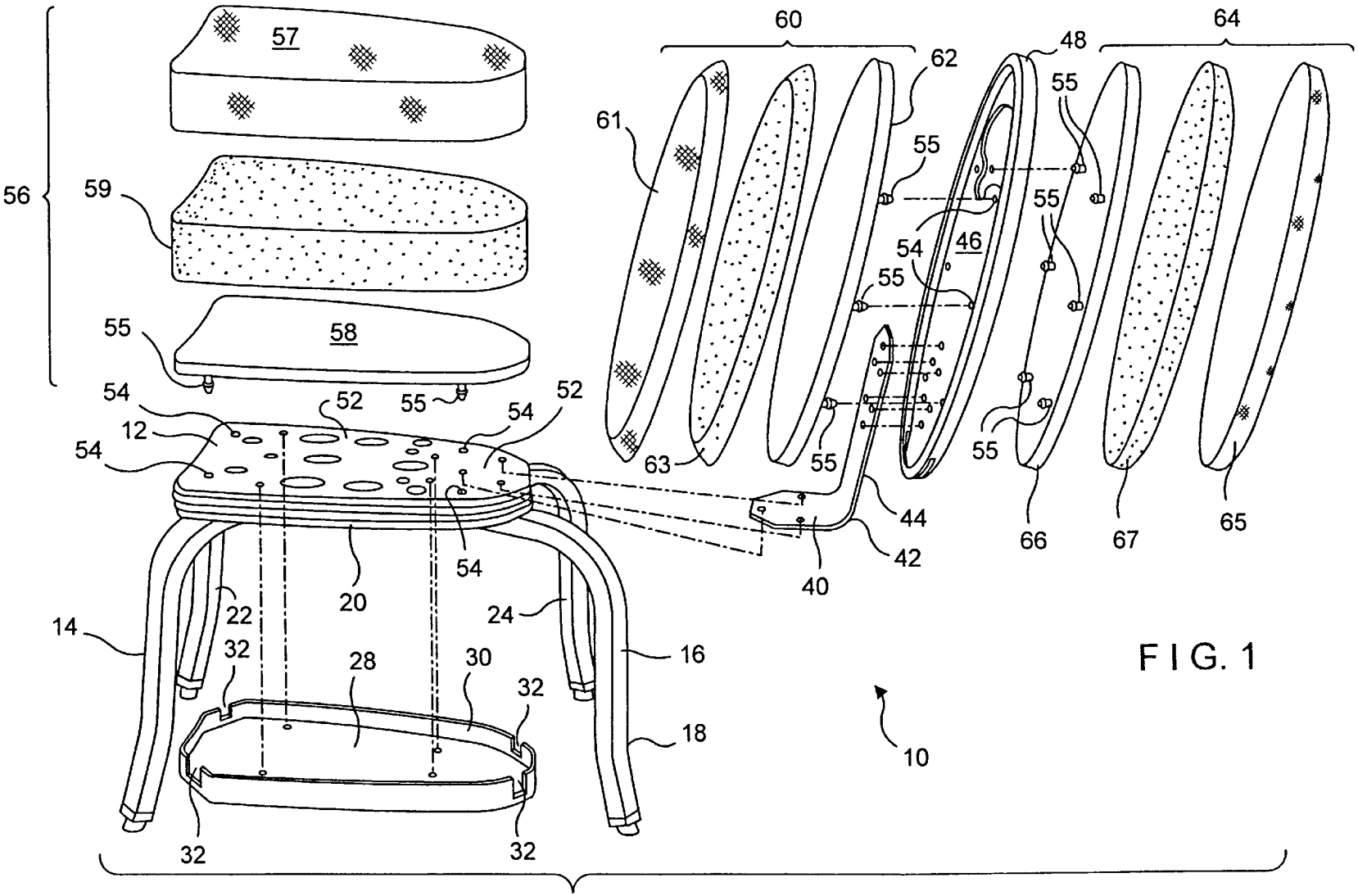
FIG. 1 is an exploded perspective view of the chair of the present invention.
Figure 4:
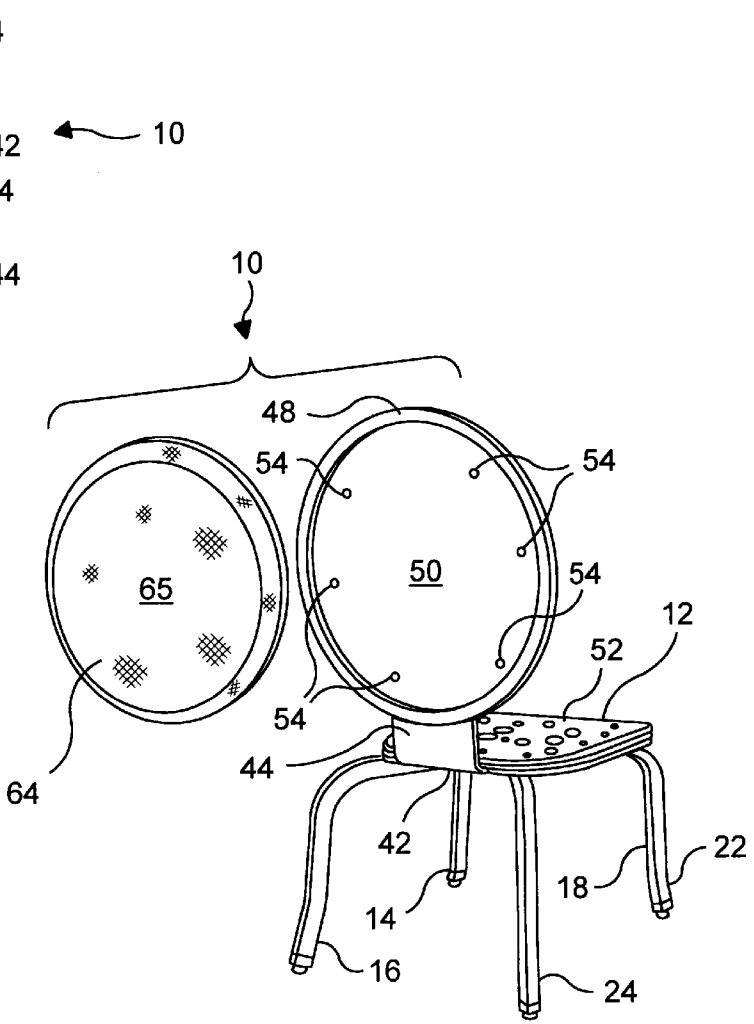
FIG. 4 is a rear perspective view of the chair of the present invention with the seat cushion removed and the rear seat back cushion, which is mounted to a molded cover plate, shown in an exploded position.
Figure 3:
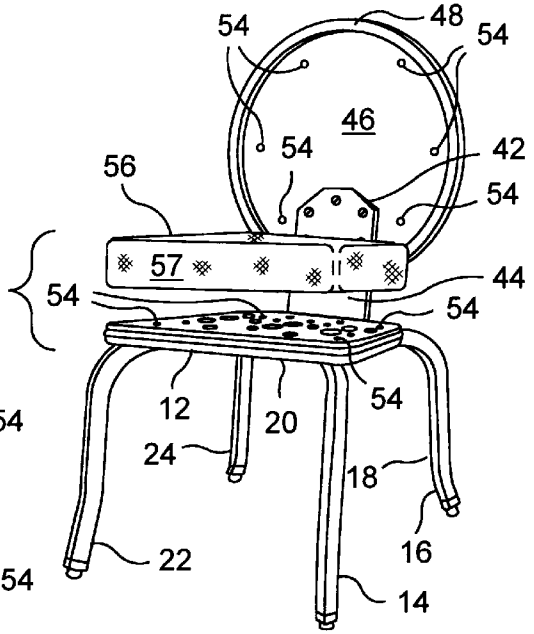
FIG. 3 is a front perspective view of the chair of the present invention with the front seat back cushion removed and the seat cushion, which is mounted to a molded cover plate, shown in an exploded position.
Figure 2:
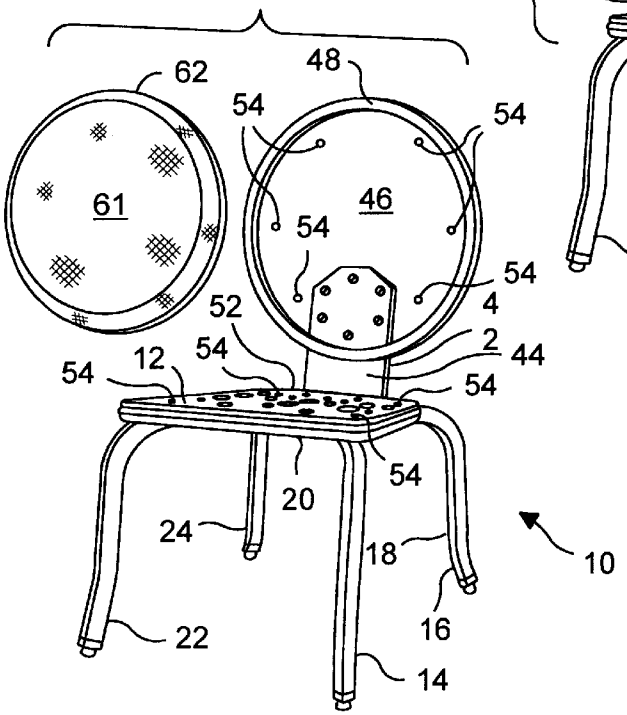
FIG. 2 is a front perspective view of the chair of the present invention with the seat cushion removed and the front seat back cushion, which is mounted to a molded cover plate, shown in an exploded position.
Figure 5:
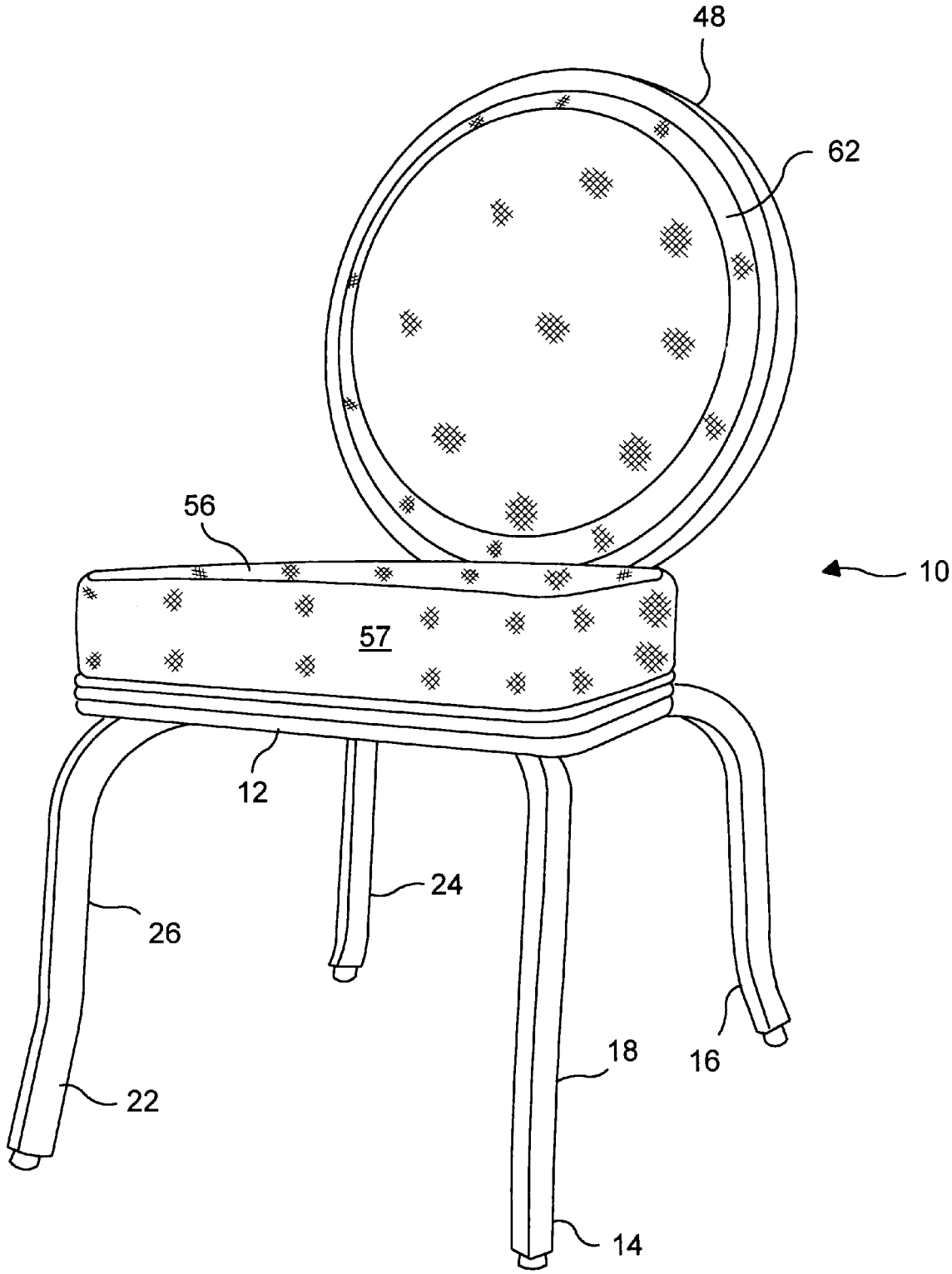
FIG. 5 is a front perspective view of the assembled chair of the present invention.
Figure 6:
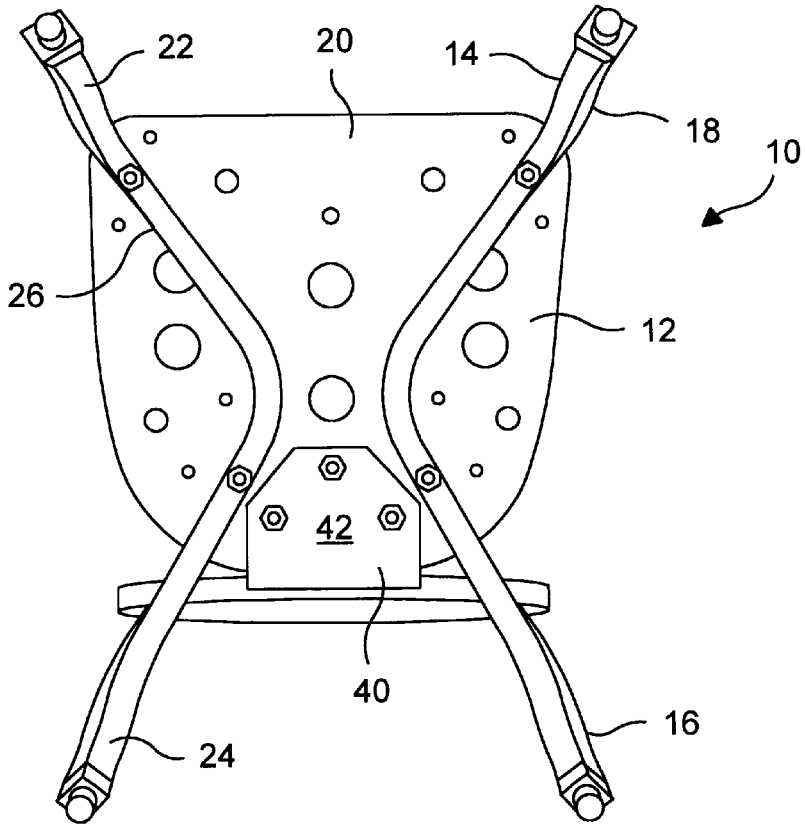
FIG. 6 is a bottom perspective view of the chair of the present invention with the guard plate removed.
Figure 7:
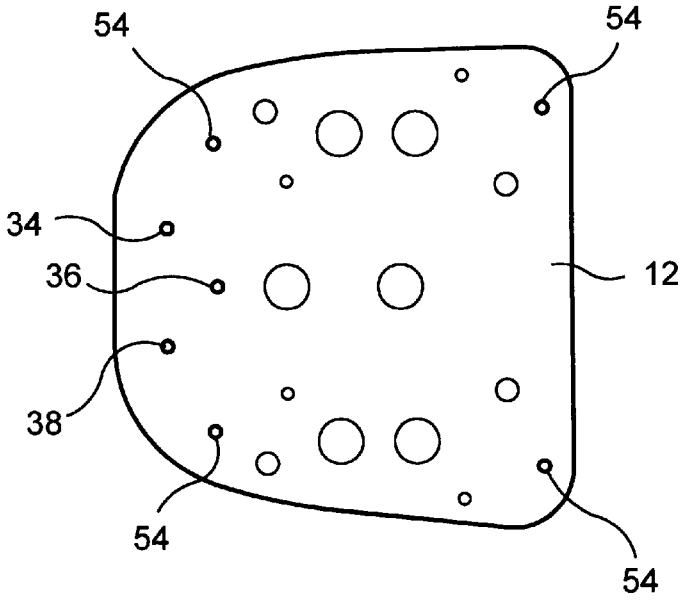
FIG. 7 is a plan view of the seat base of the chair of the present invention.
Figure 8:
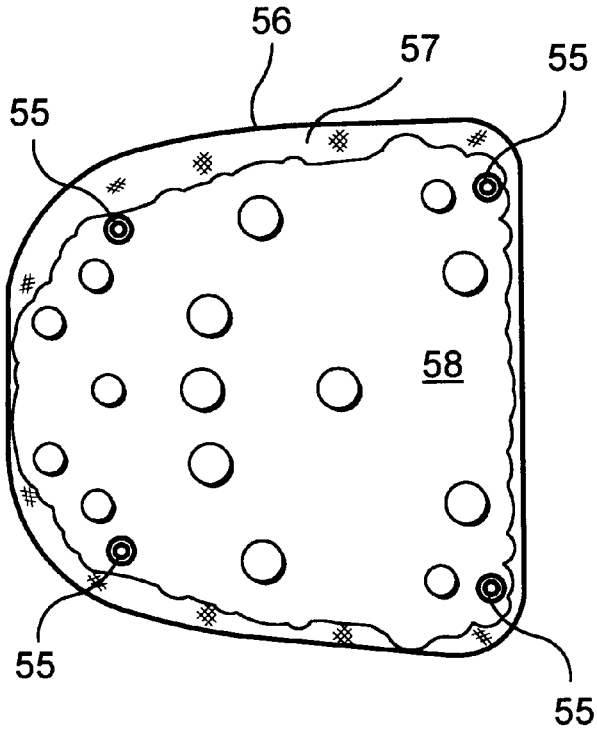
FIG. 8 is a plan view of the bottom of the seat cushion, which is mounted to a molded cover plate, of the present invention.
Figure 9:
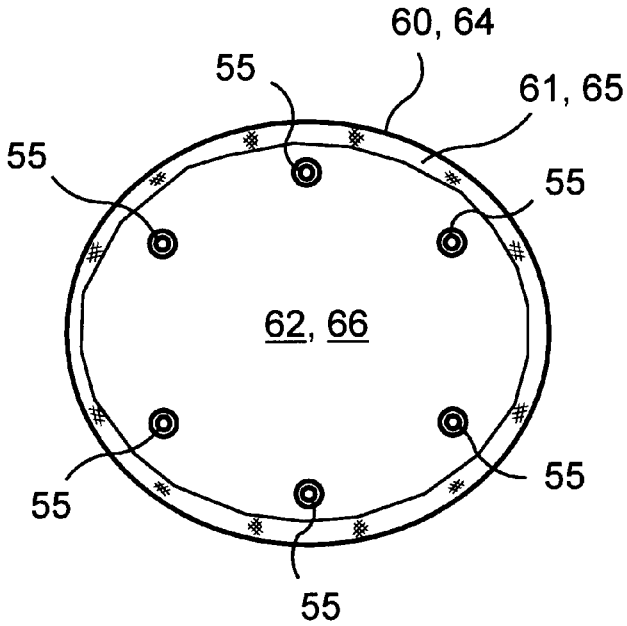
FIG. 9 is a plan view of the rear of a front or rear seat back cushion of the chair of the present invention, showing the molded plate.

Referring now to the drawings in detail wherein like numerals refer to like elements throughout the several views, one sees that FIG. 1 is an exploded view showing the components of the chair 10 of the present invention. Chair 10 includes planar horizontal seat base 12. Seat base 12 is typically made of molded plastic and can be metallized to achieve a luxurious metallic appearance. Likewise, powder-coating, painting or custom molding with custom color selection can be used to achieve a luxurious appearance. This eliminates the need for secondary finishing of seat base 12. The left legs 14, 16 are formed from a single shaped bar 18 (see FIG. 6) bolted or otherwise fastened to the bottom surface 20 of seat base 12. Likewise, right legs 22, 24 are formed from a single shaped bar 26 (see FIG. 6) bolted or otherwise fastened to the bottom surface 20 of seat base 12. A relatively planar injection molded or vacuum molded guard plate 28 with upwardly extending lip 30 can be placed over the bottom of seat base 12 to prevent the seated user or anybody else from tampering with, being injured by, or otherwise coming into contact with the hardware on the bottom of seat base 12. Additionally, guard plate 28 allows successive chairs 10 to be stacked one on top of the other without the hardware of an upper chair damaging the upholstery of a lower chair. Guard plate 28 can be attached with various molded-in place snap fasteners, hook-and-loop (VELCRO®) or other fasteners and is removable and reusable. Upwardly extending lip 30 includes channels 32 to accommodate the passage of legs 14, 16, 22, 24 therethrough after installation of guard plate 28.

The bottom surface 20 of seat base 12 further includes threaded apertures 34, 36, 38 in order to fasten horizontal section 40 of L-shaped seat back bracket 42 on bottom surface 20 of seat base 12 by the use of screws or bolts. L-shaped seat back bracket 40 likewise includes vertical section 44 integral with horizontal section 40. Vertical section 44 is attached by screws or bolts to the threaded apertures on the front surface 46 of seat back 48. Seat back 48, much like seat base 12, is typically made of molded plastic and can be metallized, powder-coated, painted or custom molded with custom color selection to obtain a luxurious appearance. Seat back 48, while illustrated as planar, is frequently curved so as to present a slightly concave front surface 46 to the back of the seated person.

The front surface 46 and rear surface 50 of seat back 48, as well as the top surface 52 of seat base 12 include releasably detachable fasteners 54 affixed thereto or integral therewith. Fasteners 54 could be insert molded metal snap post fasteners, other snap fasteners (such as button snaps) or similar fasteners (again, such as hook-and-loop, that is VELCRO®).

As shown in the various drawings, chair 10 further includes seat cushion 56 wherein seat cushion fabric 57 is upholstered to seat cushion plate 58 thereby covering seat cushion foam rubber 59; front seat back cushion 60 wherein front seat back cushion fabric 61 is upholstered to front seat back cushion plate 62 thereby covering front seat back cushion foam rubber 63; and rear seat back cushion 64 wherein rear seat back cushion fabric 65 is upholstered to rear seat back cushion plate 66 thereby covering rear seat back cushion foam rubber 67. Front and rear seat back cushion plates 62, 66 are complementary in shape to seat back 48. That is, while seat back 48 is illustrated as planar, some designs may present a concave surface to the back of the seated person. In this case, front seat back cushion plate 62 would present a convex surface to seat back 48 and rear seat back cushion plate 66 would present a concave surface to seat back 48.

Fasteners 55, complementary to fasteners 54, are affixed to or integral with seat cushion plate 58 and spaced so as to engage fasteners 54 on top surface 52 of seat base 12. For instance, if fasteners 54 are the female or aperture components of insert molded post snap fasteners, then fasteners 55 are the male or post components of insert molded snap fasteners, typically with an outwardly flared detent head. Likewise, fasteners 55, complementary to fasteners 54, are affixed to front and rear seat back cushion plates 62, 64 and spaced so as to engage fasteners 54 on front and rear surfaces 46, 50 of seat back 48. This allows for seat cushion 56 and front and rear seat back cushions 60, 64 to be releasably detachable from the remaining components of the chair. The use of snap fasteners or similar fasteners allows for cushions 56, 62, 64 to be rapidly releasably detachable and interchangeable without the need for labor-intensive operations. Similarly, the use of L-shaped seat back bracket 40, which is typically attached to seat base 12 and seat back 48 by screws, allows for the still relatively simple interchanging of seat backs 48 to seat bases 12, although it is envisioned that a simple tool such as a screwdriver would be required for this operation.

In order to assemble chair 10, a seat back 48 is chosen and is affixed to seat base 12 by the use of L-shaped seat back bracket 42. Then fasteners 55 of seat cushions 56 and front and rear seat back cushions 62, 64 of the desired design are aligned with and snap engaged or otherwise affixed to complementary fasteners 54 on top surface 52 of seat base 12 and front and rear surfaces 46, 50 of seat back 48, respectively. Guard plate 28 is inserted onto the bottom surface 20 of seat base 12.

Thus the several aforementioned objects and advantages are most effectively attained. Although a single preferred embodiment of the invention has been disclosed and described in detail herein, it should be understood that this invention is in no sense limited thereby and its scope is to be determined by that of the appended claims.

What is claimed is:

1. A chair comprising:

a seat base with an upper surface and a lower surface;

legs attached to said lower surface of said seat base;

a seat back with a front surface and a rear surface, said seat back being in mechanical communication with said seat base;

said upper surface of said seat base including first integrally affixed female fasteners, said front surface of said seat back including second integrally affixed female fasteners and said rear surface of said seat back including third integrally affixed female fasteners;

a seat cushion with a seat cushion plate including fourth integrally affixed male fasteners complementary to said first integrally affixed female fasteners and releasably detachably engaging the first female integral female fasteners;

a front seat back cushion with front seat back cushion plate including fifth integrally affixed male fasteners complementary to said second integrally affixed female fasteners and releasably detachably engaging the second female integral female fasteners;

a rear seat back cushion with a rear seat back cushion plate including sixth integrally affixed male fasteners complementary to said third and releasably detachably engaging the third female integral female fasteners.

2. The chair of claim 1 wherein said seat base is attached to said seat back by a bracket.

3. The chair of claim 2 wherein said bracket is L-shaped and is attached to said seat base and said seat back by screws or bolts.

4. The chair of claim 3 wherein said first, second, third, fourth, fifth and sixth fasteners are snap fasteners.

5. The chair of claim 4 wherein said seat back and said seat base are molded plastic.

6. The chair of claim 5 wherein said seat back and said seat base are metallized, powder coated, painted, or custom molded into custom colors.

7. The chair of claim 6 wherein said seat cushion is upholstered to said seat cushion plate, said front seat back cushion is upholstered to said front seat back cushion plate and said rear seat back cushion is upholstered to said rear seat back cushion plate.

8. The chair of claim 3 wherein said first, second and third fasteners are female elements of snap post fasteners which are insert molded into said seat base, said front surface of said seat back and said rear surface of said seat back, respectively; and said fourth, fifth and sixth fasteners are male elements of snap post fasteners which are insert molded into said seat cushion plate, said front seat back cushion plate and said rear seat back cushion plate, respectively.

9. The chair of claim 3 wherein said first, second, third, fourth, fifth and sixth fasteners are hook-and-loop fasteners.

* * * * *